US008595009B2

(12) United States Patent
Lu et al.

(10) Patent No.: US 8,595,009 B2
(45) Date of Patent: Nov. 26, 2013

(54) METHOD AND APPARATUS FOR PERFORMING SONG DETECTION ON AUDIO SIGNAL

(75) Inventors: Lie Lu, Beijing (CN); Claus Bauer, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 13/559,265

(22) Filed: Jul. 26, 2012

(65) Prior Publication Data

US 2013/0046536 A1 Feb. 21, 2013

Related U.S. Application Data

(60) Provisional application No. 61/540,346, filed on Sep. 28, 2011.

(30) Foreign Application Priority Data

Aug. 19, 2011 (CN) ..... 2011 1 0243070

(51) Int. Cl.
*G10L 21/02* (2013.01)
*G10L 21/04* (2013.01)
*G10L 21/06* (2013.01)

(52) U.S. Cl.
USPC ..... 704/253; 704/254; 704/248; 704/233; 704/238; 704/500; 704/504

(58) Field of Classification Search
USPC ..... 704/248, 253, 233, 238, 239, 503, 500
See application file for complete search history.

(56) References Cited

U.S. PATENT DOCUMENTS

| | | | | |
|---|---|---|---|---|
| 5,876,213 | A * | 3/1999 | Matsumoto | 434/307 A |
| 6,784,354 | B1 * | 8/2004 | Lu et al. | 84/616 |
| 6,819,863 | B2 * | 11/2004 | Dagtas et al. | 386/249 |
| 7,336,890 | B2 | 2/2008 | Lu | |
| 2002/0120456 | A1 | 8/2002 | Berg | |
| 2004/0170392 | A1 * | 9/2004 | Lu et al. | 386/96 |
| 2004/0216585 | A1 * | 11/2004 | Lu et al. | 84/616 |
| 2006/0065106 | A1 | 3/2006 | Pinxteren | |

(Continued)

FOREIGN PATENT DOCUMENTS

EP 1968043 9/2008

OTHER PUBLICATIONS

L. Lu, Stan Li, H, J. Zhang. "Content-based Audio Segmentation Using Support Vector Machines". Proc. of ICME 2001, pp. 956-959, Tokyo, Japan, 2001.*

(Continued)

*Primary Examiner* — Pierre-Louis Desir
*Assistant Examiner* — Abdelali Serrou

(57) ABSTRACT

Methods and apparatuses for performing song detection on an audio signal are described. Clips of the audio signal are classified into classes comprising music. Class boundaries of music clips are detected as candidate boundaries of a first type. Combinations including non-overlapped sections are derived. Each section meets the following conditions: 1) including at least one music segment longer than a predetermined minimum song duration, 2) shorter than a predetermined maximum song duration, 3) both starting and ending with a music clip, and 4) a proportion of the music clips in each of the sections is greater than a predetermined minimum proportion. In this way, various possible song partitions in the audio signal can be obtained for investigation.

18 Claims, 5 Drawing Sheets

(56) References Cited

U.S. PATENT DOCUMENTS

| | | | | |
|---|---|---|---|---|
| 2006/0085188 | A1 | 4/2006 | Goodwin | |
| 2008/0052516 | A1* | 2/2008 | Tachibana et al. | 713/176 |
| 2008/0147218 | A1* | 6/2008 | Sugino et al. | 700/94 |
| 2009/0088877 | A1* | 4/2009 | Terauchi et al. | 700/94 |
| 2010/0286989 | A1* | 11/2010 | Urata et al. | 704/500 |

OTHER PUBLICATIONS

Su et al. "An Integrated Approach to Music Boundary Detection", National Taiwan University, 2009, pp. 1-6.*

Lu, L. et al., "Content-Based Audio Classification and Segmentation by Using Support Vector Machines", Multimedia Systems (8), 482-292, 2003.

Wakefield, G.H., "Mathematical Representation of Joint TimeChroma Distributions" SPIE, 1999.

Lu, L. et al., "Automatic Mood Detection and Tracking of Music Audio Signals" IEEE Transactions on Audio, Speech and Language Processing, 2006.

McKinney, M.F. et al. "Features for Audio and Music Classification" Proc. ISMIR, 2003.

Freund, Y. et al., "A Short Introduction to Boosting" Journal of Japanese Society for Artificial Intelligence 14(5): 771-780, 1999.

Siegler, M. et al., "Automatic Segmentation, Classification and Clustering of Broadcast News Audio", Proc. DARPA Speech Recognition, 1997.

Goto, M., "A Chorus-Section Detecting Method for Musical Audio Signals", Proc. Acoustics, Speech, and Signal Processing, 2003.

Bartsch, M.A. et al. "To Catch a Chorus: Using Chroma-Based Representations for Audio Thumbnailing", Proc. WASPAA 2001.

Lu, L. et al., "Repeating Pattern Discovery and Structure Analysis from Acoustic Music Data", Proc. the 6th ACM SIGMM International Workshop on Multimedia Information Retrieval, 2004.

Chen, S.S. et al., "Speaker, Environment and Channel Change Detection and Clustering Via the Bayesian Information Criterion" DARPA Broadcast News Transcription Workshop, 1998.

* cited by examiner

METHOD AND APPARATUS FOR PERFORMING SONG DETECTION ON AUDIO SIGNAL

CROSS REFERENCE TO RELATED APPLICATIONS

This Application claims the benefit of priority to related, co-pending Chinese Patent Application number 201110243070.6 filed on 19 Aug. 2011 and U.S. Pat. Application No. 61/540,346 filed on 28 Sep. 2011 entitled "Method and Apparatus for Performing Song Detection on Audio Signal" by Lu, Lie et al. hereby incorporated by reference in its entirety.

TECHNICAL FIELD

The present invention relates generally to audio signal processing. More specifically, embodiments of the present invention relate to methods and apparatuses for performing song detection on audio signals.

BACKGROUND

In many audio applications, audio signals are recorded. For example, in a frequency modulation (FM) recording application in mobile phones, tablet computers, or other portable devices, FM programs can be recorded in response to user operations on recording buttons or based on a reservation. Recorded audio signals may include a mixture of song, speech (including speech-over-music), noise, silence, etc. Users may desire to only save individual songs in the recorded audio signals.

An approach has been proposed to detect songs from audio signals based on repeating occurrences of audio segments in the audio signals, assuming that a repeated long audio segment is a song while speech seldom repeats for multiple times. An example implementation of the approach can be found in PopCatcher Internet Radio Recorder Application from PopCatcher AB, Hastholmsvagen 28, 5tr, 131 40 Nacka, SWEDEN, which is herein incorporated by reference for all purposes.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section Similarly, issues identified with respect to one or more approaches should not assume to have been recognized in any prior art on the basis of this section, unless otherwise indicated.

SUMMARY

According to an embodiment of the invention, a method of performing song detection on an audio signal is provided. Clips of the audio signal are classified into classes comprising music. Class boundaries of the music clips are detected as candidate boundaries. At least one combination including one or more non-overlapped sections bounded by the candidate boundaries are derived. Each of the sections meets the following conditions: 1) including at least one music segment longer than a predetermined minimum song duration as a candidate song, 2) shorter than a predetermined maximum song duration, 3) both starting and ending with a music clip, and 4) a proportion of the music clips in each of the sections is greater than a predetermined minimum proportion.

According to another embodiment of the invention, an apparatus for performing song detection on an audio signal is provided. The apparatus includes a classifying unit, a boundary detector and a song searcher. The classifying unit classifies clips of the audio signal into classes comprising music. The boundary detector detects class boundaries of the music clips as candidate boundaries. The song searcher derives at least one combination including one or more non-overlapped sections bounded by the candidate boundaries. Each of the sections meets the following conditions: 1) including at least one music segment longer than a predetermined minimum song duration as a candidate song, 2) shorter than a predetermined maximum song duration, 3) both starting and ending with a music clip, and 4) a proportion of the music clips in each of the sections is greater than a predetermined minimum proportion.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only.

Additional embodiments will be apparent to persons skilled in the relevant art(s) based on the teachings contained herein.

BRIEF DESCRIPTION OF DRAWINGS

The present invention is illustrated by way of examples, and not by way of limitation, in the figures of the accompanying drawings and in which like reference numerals refer to similar elements and in which.

DETAILED DESCRIPTION

Figure 1:
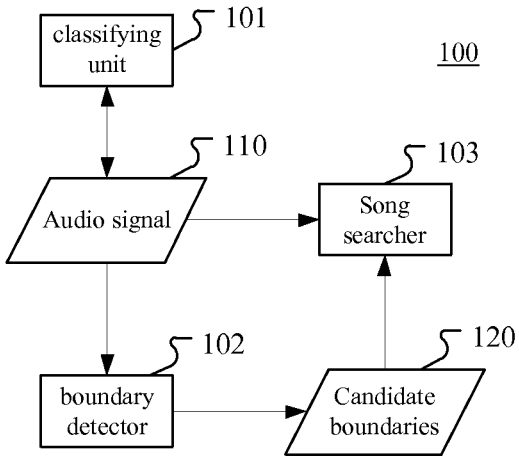
FIG. 1 is a block diagram illustrating an example apparatus for performing song detection on an audio signal according to an embodiment of the present invention.

The embodiments of the present invention are below described by referring to the drawings. It is to be noted that, for purpose of clarity, representations and descriptions about those components and processes known by those skilled in the art but unrelated to the present invention are omitted in the drawings and the description.

As will be appreciated by one skilled in the art, aspects of the present invention may be embodied as a system (e.g., an online digital media store, cloud computing service, streaming media service, telecommunication network, or the like), device (e.g., a cellular telephone, portable media player, personal computer, television set-top box, or digital video recorder, or any media player), method or computer program product. Accordingly, aspects of the present invention may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof.

A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wired line, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Detecting Songs Based on Candidate Boundaries

FIG. 1 is a block diagram illustrating an example apparatus 100 for performing song detection on an audio signal according to an embodiment of the present invention.

As illustrated in FIG. 1, apparatus 100 includes a classifying unit 101, a boundary detector 102 and a song searcher 103.

Audio signal 110 to be processed by apparatus 100 includes a plurality of consecutive clips. Each clip includes a plurality of consecutive frames. The length of the clips and the length of the frames depend on the requirement of the classification model for classifying the clips.

Classification

Classifying unit 101 classifies the clips of audio signal 110 into classes comprising music. In the context of this specification, the term "music" includes songs with instrumental sound and songs without instrumental sound.

The classification model may be trained based on training sample sets for the classes to be identified (e.g., music). Various models for classifying objects may be adopted. For example, the classification model may be based on adaBoost, Support Vector Machine, Hidden Markov Model, or Gaussian Mixture Model.

Various features for characterizing the difference between audio signals of the classes to be identified may be adopted in the classification model. For example, the features of each frame (also called as frame-level features) may comprise at least one of timbre-related feature and chroma feature. The timbre-related feature may be used to distinguish different types of sound production such as music, speech, etc. For example, the timbre-related feature may comprise at least one of zero-crossing rate, short-time energy, sub-band spectral distribution, spectral flux and Mel-frequency Cepstral Coefficient. Chroma feature may be used to represent the melody information of an audio signal. For example, chroma feature is generally defined as a 12-dimensional vector where each dimension corresponds to the intensity of a semitone class (there are 12 semitones in an octave).

In an example implementation of classifying unit 101, classifying unit 101 may calculate frame-level features of frames in each clip and derive features for characterizing variation of the frame-level features (also called as clip-level features) from the frame-level features of the clip. The clip-level features may be used to capture the rhythmic property of different sounds and especially to differentiate speech and music. For example, the clip-level features of a clip may comprise mean and standard deviation of the frame-level features of the clip, and/or rhythmic feature. The rhythmic feature of a clip may be used to capture regular recurrence or pattern in the frame-level features of the clip. For example, the rhythmic feature comprises at least one of rhythm strength, rhythm regularity, rhythm clarity and two dimension (2D) sub-band modulation. Each clip may be classified based on the corresponding clip-level features.

The function of calculating the features may be implemented in classifying unit 101, or may be implemented in a separate feature extractor (not illustrated in FIG. 1).

In some circumstances, song signals recorded in audio signal 110 may include noise due to short time interference or other factors. In a further embodiment of classifying unit 101, the classes identified by classifying unit 101 may further comprise noise. Classifying unit 101 may further re-classify any noise segment adjoining with two music clips and having a length smaller than a threshold as music. The threshold may be obtained based on statistics on length of noise in sample song recordings. In this way, true song signal which incorrectly recorded as noise can be corrected as music class.

In some circumstances, clips in songs may be incorrectly classified as non-music. The clips generally present as sudden changes in long music segments. In a further embodiment of classifying unit 101, classifying unit 101 may further calculate confidence for the class of each of the clips. Classifying unit 101 may comprise a first median filter and one or more second median filters with different smoothing windows. The first median filter smoothes the clips from the start to the stop of the audio signal. For each current clip, if the confidence of the clip is lower than a threshold and the class of the clip is different from the median of the classes of the clips in a smoothing window centered at the clip, the class of the clip is updated with the median. The threshold is used to determine whether a confidence can indicate a correct classification. It can be set in advance, or can be learned by testing the classifier with a sample set. The second median filters with different smoothing windows smooth the clips subsequently. In this way, such incorrectly classified clips can be reclassified as music.

Detecting Candidate Boundaries

A—Detecting Based on Classification

Because every song can exhibit as a segment of one or more consecutive music clips (also called as music segment in the following), class information of the clips in audio signal 110 may reveal one kind of information on true songs included in audio signal 110. Specifically, every music segment may be found from audio signal 110 based on the class information of the clips, and the music segment may be viewed as estimation to the corresponding true song.

Boundary detector 102 detects class boundaries of the music clips (between music clip and non-music clip) as candidate boundaries 120. In this way, music segments which may be estimated as true songs can be detected.

B—Detecting Based on Feature Dissimilarity

Further, in case of continuous playing, for example, two or more consecutive songs can also exhibit as one music segment (e.g., music mixing or sampling). In this case, a sole music segment determined according to the class information is not always sufficient to discover the true boundary of the songs. It is possible to improve this estimation by exploiting the fact that for two segments belonging to different songs, features of signals in the different segments may exhibit some different characteristics (that is, lower consistency/higher dissimilarity).

In a further embodiment of boundary detector 102, boundary detector 102 may also detect positions as candidate boundaries 120 if feature dissimilarities between two windows disposed about the position within any music segment in audio signal 110 is higher than a threshold $TH_D$. The threshold $TH_D$ may be determined based on statistics on feature dissimilarities calculated from sample signals including consecutive songs. In this way, it is possible to detect candidate boundaries for separating consecutive songs. To distinguish the candidate boundaries detected based on classification and based on feature dissimilarity, the candidate boundaries detected based on classification are called as a first type and the candidate boundaries based on feature dissimilarity are called as a second type.

Figure 2A:
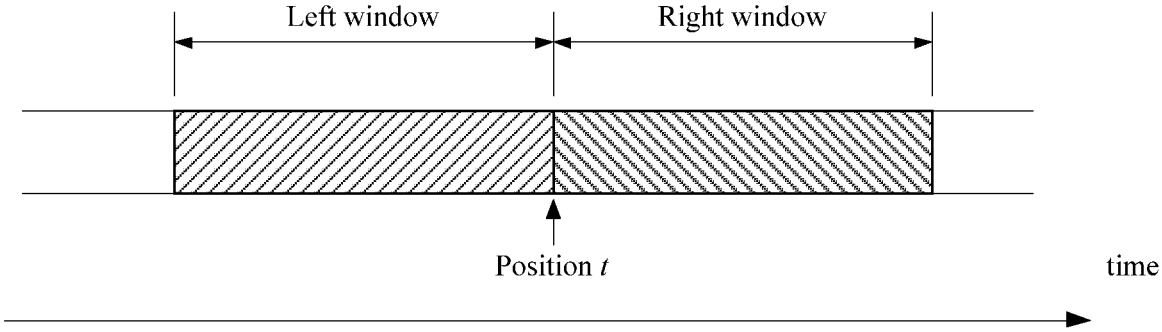
FIG. 2A is a schematic view for illustrating the detection of candidate boundaries.

FIG. 2A is a schematic view for illustrating an example detection of candidate boundaries of the second type. As illustrated in FIG. 2A, for each position t within a music segment, a left window is located at the immediately left side of position t, and a right window is located at the immediately right side of position t. A feature dissimilarity between features extracted from frames of the left window and features extracted from frames of the right window may be calculated. Alternatively, the left and right windows can be located away for position t by a separation margin.

Various methods of evaluating the feature dissimilarity between features of two windows can be adopted in boundary detector 102. For example, the feature dissimilarity between two windows may be calculated as Kullback-Leibler Divergence (KLD).

In an example, the feature dissimilarity $D_{sKLD}$ may be calculated as a symmetric KLD by $$D_{sKLD} = \frac{1}{2}tr[(C_l - C_r)(C_r^{-1} - C_l^{-1})] + \frac{1}{2}tr[(C_l^{-1} + C_r^{-1})(u_l - u_r)(u_l - u_r)^T], \quad (1)$$

where $C_l$ and $C_r$ are covariance matrices of features extracted from frames of the left window and the right window respectively, $u_l$ and $u_r$ are corresponding means, tr[X] is the sum of diagonal elements of a matrix X.

Various features extracted from frames may be used for calculating the feature dissimilarity. The function for calculating the features may be included in boundary detector 102, or may be implemented in a separate feature extractor (not illustrated in FIG. 1). In an example, the features for calculating the feature dissimilarity may be the frame-level features described in connection with classifying unit 101.

Figure 2B:
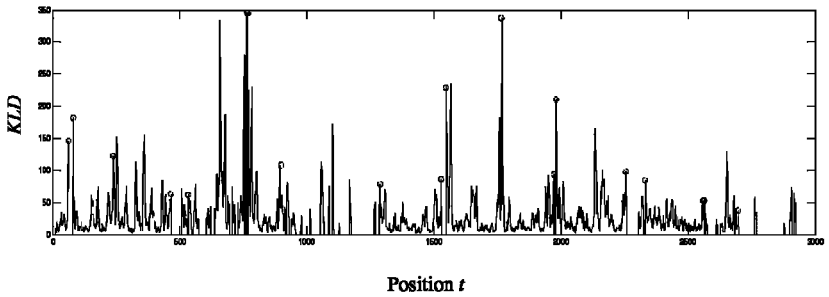
FIG. 2B shows an example of a Kullback-Leibler Divergence (KLD) sequence calculated over a 1-hour audio signal.

FIG. 2B shows an example of the KLD sequence calculated over a 1-hour audio signal, with small circles indicating true song boundaries. It can be seen that the distance is a little noisy. The distance is not always large at a true song boundary, while there are also many large distances within a song. The threshold $TH_D$ may be determined to ensure that most or all the local peak KLDs is higher than the threshold $TH_D$. Therefore more true song boundaries that are missed due to consecutive songs can be detected as candidate boundaries for further investigation.

In an example, the threshold $TH_D$ is determined as an adaptive threshold $th_{seg}(\alpha)$ $$th_{seg}(\alpha)=\text{mean}+\alpha\cdot std \tag{2}$$

where mean and std is the mean and standard deviation of the calculated feature dissimilarity respectively, and $\alpha$ is a tuning parameter, typically in a range from 0 to about 3 (e.g., equal to 1.2).

C—Verifying Based on Content Coherence

In audio signal 110, the candidate boundaries may be boundaries of true songs. It is possible to judge whether the candidate boundaries are boundaries of true songs or not by investigating a broad range (if compared with the windows for calculating the feature dissimilarity in candidate boundary detector) of segments surrounding the candidate boundaries. The content coherence (distance) serves as a metric to further jud0ge if a candidate boundary is a true song start/stop boundary. If the content coherence (distance) is large (small), the content of the surrounding segments is similar and thus the candidate boundary is not a true song start/stop boundary; otherwise, if the content coherence (distance) is small (large), the boundary is true.

In a further embodiment of boundary detector 102, for each boundary t of the candidate boundaries, boundary detector 102 calculates at least one content coherence distance between two windows (e.g., one minute long) surrounding the boundary t. If more than one content coherence distances are calculated for one boundary, features for calculating the content coherence distances are at least partly different from each other.

Figure 3:
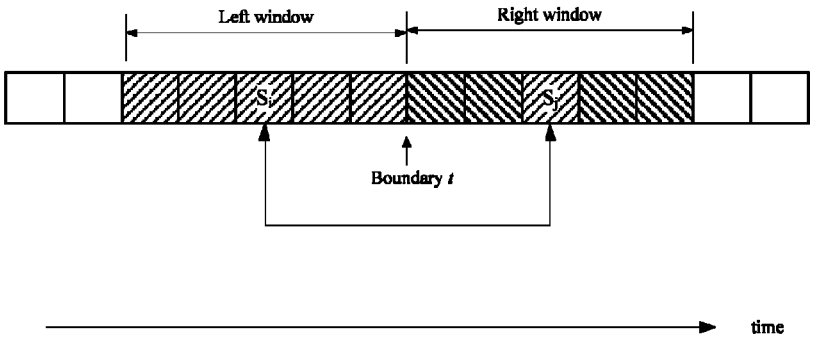
FIG. 3 is a schematic view for illustrating an example method of calculating the content coherence distance.

Various methods of calculating coherent distance between two contents may be adopted. FIG. 3 is a schematic view for illustrating an example method of calculating the content coherence distance. As illustrated in FIG. 3, a left window and a right window are divided into small segments, and the content coherence distance is derived from distances (e.g., KLD) between pairs of segments $s_i$ in the left window and corresponding segments $s_j$ in the right window.

Various features may be adopted to calculate the content coherence distance. For example, features for calculating the content coherence distance may comprise at least one of chroma feature, timbre-related feature and Rhythm-related feature. In a further example, the Rhythm-related feature may be obtained through at least one of tempo estimation, beat/bar detection and rhythm pattern extraction.

For each boundary t of the candidate boundaries, boundary detector 102 calculates a possibility (e.g., confidence) that boundary t is the true boundary of a song based on the at least one corresponding content coherence distance. Various methods may be adopted to calculate the possibility. For example, a sigmoid function may be adopted to calculate the possibility. For another example, the possibility conf may be calculated based on the content coherence distance $D_{coh}$ as $$conf = \begin{cases} VH & D_{coh} \geq Th_{ub} \\ VM & D_{coh} \in [Th_{lb}, Th_{ub}) \\ VL & D_{coh} < Th_{lb} \end{cases} \tag{3}$$

where $Th_{lb}$ and $Th_{ub}$ are the lower-bound threshold and upper-bound threshold respectively, VH (e.g., 1) is a value representing that boundary t is true, VM (e.g., 0) is a value representing that boundary t is false, and VM (e.g., 0.5) is a value representing that boundary t is uncertain yet (neither true nor false).

If multiple content coherence distances are computed based on different features, they can be combined in various ways. For example, it is possible to set the possibility to VH if all the content coherence distances are larger than the corresponding upper-bound thresholds, or more loosely, if any one of the content coherence distances is larger than the corresponding upper-bound threshold. Another probabilistic way is to build a model to represent the joint distribution model of these distances based on a training set.

If the possibility indicates that boundary t is a false boundary, boundary detector 102 may perform the following processing.

If boundary t is within a music segment, boundary detector 102 may remove boundary t if the music segment including only boundary t and bounded by two candidate boundaries has a length smaller than the predetermined maximum song duration.

If a speech segment bounded by boundary t and another candidate boundary has a length smaller than a threshold, boundary detector 102 may identify the two candidate boundaries as to-be-removed. The threshold may be obtained based on statistics on speech segments between two songs.

Boundary detector 102 may remove all the to-be-removed candidate boundaries, or boundary detector 102 may change one or more pairs of two to-be-removed candidate boundaries bounding a music segment as the second type and remove the remaining to-be-removed candidate boundaries.

In a further embodiment of boundary detector 102, in case that the possibility neither indicates that boundary t is a true boundary nor indicates that boundary t is a false boundary, if boundary t is of the second type (that is, within a music segment), boundary detector 102 may calculate a probability $P(H_0)$ that two music segments of durations $l_1$ and $l_2$ adjoining with each other at boundary t are two true songs with a pre-trained song duration model, and calculate a probability $P(H_1)$ that a music segment obtained by merging the two music segments is a true song with the pre-trained song duration model. If the following condition is not met, boundary detector 102 remove boundary t:

$$\frac{P(H_0)}{P(H_1)} = \frac{G(l_1)G(l_2)}{G^2(l_1+l_2)} \geq 1, \tag{4}$$

wherein the pre-trained song duration model is a Gaussian model $G(l;\mu,\sigma)$.

D—Verifying Based on Repetitive Sections

In a further embodiment of boundary detector 102, boundary detector 102 may search for one or more pairs of two repetitive sections $[t_1, t_2]$ and $[t_1+l, t_2+l]$ in audio signal 110, where the lag l is shorter than the predetermined maximum song duration.

In general, in comparison with other kinds of content, songs may exhibit unique characteristics by including repetitive sections, i.e., segments with the same melody. It is possible to assume a section $[t_1, t_2+l]$ between the repetitive sections $[t_1, t_2]$ and $[t_1+l, t_2+l]$ as belonging to one song. Therefore, if one candidate boundary in the section $[t_1, t_2+l]$ is within a music segment, boundary detector 102 may remove the candidate boundary. If a speech segment in the section $[t_1, t_2+l]$ bounded by two candidate boundaries has a length smaller than a threshold, boundary detector 102 may identify the two candidate boundaries as to-be-removed. Boundary detector 102 may remove all the to-be-removed candidate boundaries, or may change one or more pairs of two to-be-removed candidate boundaries bounding a music segment as the second type and remove the remaining to-be-removed candidate boundaries. The threshold may be obtained based on statistics on the length of music segments misclassified as speech in sample songs.

In this way, candidate boundaries may be verified based on repetitive sections in the audio signal, reducing the possibility that false boundaries between songs are detected as true song boundaries.

Various methods of detecting repetitive sections in audio signals may be adopted by boundary detector 102 to search for repetitive sections in the segments. For example, methods based on similarity matrix or time-lag similarity matrix may be adopted.

In a further embodiment of boundary detector 102, boundary detector 102 may calculate an adaptive threshold for binarizing the similarity matrix based on a percentile. In case of sorting similarity values in the similarity matrix in descending order, only the first small percentage of the similarity values depending on the percentile are binarized to a value representing repetition. The percentile is a product of the proportion of the music clips in the corresponding segment and a pre-defined base percentile. In this way, the percentile and the adaptive threshold are both adaptive to the proportion of music content in the segment.

In a further embodiment of boundary detector 102, boundary detector 102 may only search for the repetitive sections longer than a threshold. The threshold may be obtained based on statistics on the length of repetitive sections in sample songs. In this way, only those repetitive sections long enough can be detected.

In a further embodiment of boundary detector 102, boundary detector 102 may search for sections $[t_1, t_2]$ and $[t_1+l, t_2+l]$ such that the music clips are in the majority of section $[t_1, t_2+l]$. For example, the proportion of the clips classified as music in section $[t_1, t_2+l]$ is greater than 50%. For another example, the proportion ml of the clips classified as music in the section $[t_1, t_2]$, the proportion m2 of the clips classified as music in the section $[t_1+l, t_2+l]$, the proportion mc of the clips classified as music in the section $[t_2, t_1+l]$ and the sum ms of m1, m2 and mc may meet some conditions, such as one of the following conditions:

condition 1: $m1>0.5 \text{ and } m2>0.5 \text{ and } mc>0.5$ condition 2: $m1>0.1 \text{ and } m2>0.1 \text{ and } mc>0.1 \text{ and } ms>1.8.$ In these ways, it is possible to reduce the chance of detecting non-music sections such as speech sections as repetitive sections.

It should be noted that, in case of verifying the candidate boundaries based on both content coherence and repetitive sections, they can be performed in either order.

In a further embodiment of boundary detector 102, boundary detector 102 may merge two of the candidate boundaries spaced with a distance smaller than a threshold as one candidate boundary. The threshold may be a value smaller than or equal to the minimum song duration. The merged candidate boundary may be any one position between the two candidate boundaries.

Song Detection

Returning to FIG. 1, song searcher 103 derives at least one combination including non-overlapped sections bounded by the candidate boundaries. The sections meet the following conditions:

1) including at least one music segment longer than a predetermined minimum song duration (called as candidate song), 2) shorter than a predetermined maximum song duration, 3) both starting and ending with a music clip, and 4) a proportion of the music clips in each of the sections is greater than a predetermined minimum proportion.

The predetermined minimum song duration and the predetermined maximum song duration may be determined from statistics on length of various songs, or may be specified by a user who desires songs of a length within a specific range.

Any portion bounded between two candidate boundaries in the audio signal meeting conditions 1) to 4) may be regarded as a possible section. Therefore, there may be multiple possible sections in the audio signal. The possible sections not overlapped with each other may be selected to form a combination. Alternatively, depending on specific application requirements, the number of sections in combinations may be set to a specific number, e.g., 2, 3 and so on.

In this way, various possible song partitions in the audio signal may be obtained as the derived combinations. Based on these combinations, a desired song partition may be selected manually or automatically.

Figure 4:
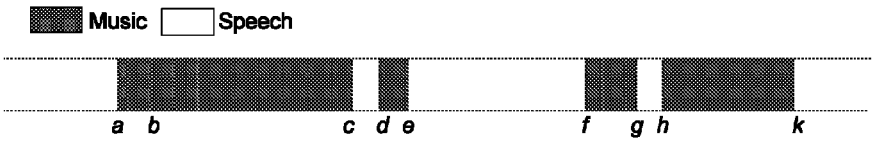
FIG. 4 is a schematic view for illustrating an example of classification result and candidate boundaries.

FIG. 4 is a schematic view for illustrating an example of classification result and candidate boundaries. As illustrated in FIG. 4, there are candidate boundaries a, b, c, d, e, f, g, h and k.

Two candidate boundaries bounding a possible section may be subsequent, that is to say, there is no other candidate boundary between the two candidate boundaries. In this case, the possible section is an undividable music segment. For example, Candidate boundaries b and c bounds an undividable music segment [b, c]. Two candidate boundaries bounding a possible section may also include one or more other candidate boundaries. In this case, the possible section includes at least two undividable segments. For example, possible section [a, c] includes two undividable segments [a, b] and [b, c], and possible section [b, e] includes undividable segments [b, c], [c, d] and [d, e].

In case of forming a combination including only one section, any possible section may be selected. In case of a combination including more than one section, at least two possible sections which are not overlapped with each other may be selected as sections to form a combination. Different combinations may have a different number of sections. For example, from the audio signal in FIG. 4, combinations ([b, c], [f, k]), ([a, b], [b, e], [h, k]), ([a, e], [f, k]) may be formed, supposing that conditions 1) to 4) can be met.

If the possibility based on the content coherence distance indicates that a candidate boundary is true, this candidate boundary cannot be within any section of the combinations. In a further embodiment of song searcher 103, in deriving a combination, song searcher 103 excludes any combination including a section where the possibility corresponding to one candidate boundary within the section indicates that the candidate boundary is a true boundary. That is to say, the possibility corresponding to each candidate boundary within the sections does not indicate that the candidate boundary is a true boundary.

In a further embodiment of song searcher 103, song searcher 103 may detect each music segment bounded by two subsequent candidate boundaries $t_1$ and $t_2$ and longer than the predetermined minimum song duration as a candidate song, and form the combination by including the candidate song [$t_1$, $t_2$] or their extensions as a section. The sections in the formed combination are not overlapped with each other, and also meet the above-mentioned conditions 1) to 4). Each extension may be obtained by at least one of the followings:

extending the boundary $t_1$ of the candidate song [$t_1$, $t_2$] to the candidate boundary $t_1-l_1$ of a music segment [$t_1-l_1$, $t_1-l_2$] in the left direction; and extending the boundary $t_2$ of the candidate song [$t_1$, $t_2$] to the candidate boundary $t_2+l_4$ of a music segment [$t_2+l_3$, $t_2+l_4$] in the right direction.

In this way, the case where some impossible combinations are obtained and then are excluded by verifying whether they meet the conditions is likely to be avoided, thus reducing the computation cost.

In case that boundary detector 102 verifies the candidate boundaries based on content coherence as described in the above, in a further embodiment of song searcher 103, song searcher 103 may obtains the extensions in a way such that:

the extending in the left direction is stopped if the possibility based on content coherence distance of the candidate boundary $t_1-l_1$ of the music segment [$t_1-l_1$, $t_1-l_2$] being extended to indicates that the candidate boundary $t_1-l_1$ is a true song boundary, and the extending in the right direction is stopped if the possibility based on content coherence distance of the candidate boundary $t_2+l_4$ of the music segment [$t_2+l_3$, $t_2+l_4$] being extended to indicates that the candidate boundary $t_2+l_4$ is a true song boundary.

In this way, it is possible to exclude the sections including a true song boundary, thus improving the accuracy of the song detection.

Further, it is possible to incorporate a requirement that if a non-music (e.g., speech) segment is to be included in performing the extending and the non-music segment is longer than a pre-defined threshold, the extending may be stopped.

In a further embodiment of song searcher 103, more than one combination may be derived by song searcher 103. In this case, song searcher may further separate the combinations into different groups. Every combination in each group includes the same candidate song(s) and each section in the combination includes the same candidate song(s) with one section in another combination of the same group. In the example illustrated in FIG. 4, it is supposed that music segments [b, c] and [h, k] are candidate songs. In this case, song searcher 103 may derive combinations ([b, c], [h, k]), ([a, c], [f, k]), ([b, e], [f, k]) and ([b, k]). The combinations ([b, c], [h, k]), ([a, c], [f, k]) and ([b, e], [f, k]) include the same candidate songs [b, c] and [h, k]. Each section of [b, c], [a, c] and [b, e] includes the same candidate song [b, c], and each section of [h, k] and [f, k] includes the same candidate song [h, k]. Therefore, the combinations ([b, c], [h, k]), ([a, c], [f, k]), ([b, e], [f, k]) belong to the same group. For every two combinations belonging to different groups, at least one section in one of the two combinations does not include the same candidate song(s) with each section in another of the two combinations. Also in the example illustrated in FIG. 4, because the candidate songs [b, c] and [h, k] included in one section [b, k] of the combination ([b, k]) is not the same with any candidate song [b, c] or [h, k] included in each section of the combinations ([b, c], [h, k]), ([a, c], [f, k]), ([b, e], [f, k]), the combination ([b, k]) belongs to a different group.

Figure 5:
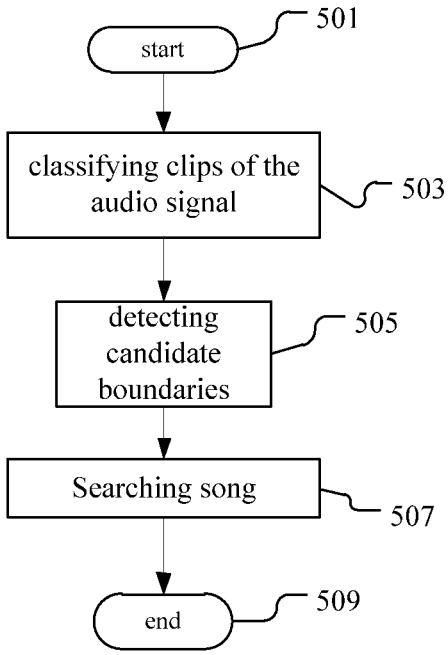
FIG. 5 is a flow chart illustrating an example method of performing song detection on an audio signal according to an embodiment of the present invention.

FIG. 5 is a flow chart illustrating an example method 500 of performing song detection on an audio signal according to an embodiment of the present invention.

As illustrated in FIG. 5, method 500 starts from step 501. At step 503, clips of the audio signal are classified into classes comprising music.

In an example implementation of step 503, it is possible to calculate frame-level features of frames in each clip and derive clip-level features for characterizing variation of the frame-level features from the frame-level features of the clip. The clip-level features may be used to capture the rhythmic property of different sounds and especially to differentiate speech and music.

In a further implementation of step 503, the classes identified at step 503 may further comprise noise. It is possible to further re-classify any noise segment adjoining with two music clips and having a length smaller than a threshold as music. The threshold may be obtained based on statistics on length of noise in sample song recordings.

In a further implementation of step 503, it is possible to further calculate confidence for the class of each of the clips. Further, it is possible to smooth the clips from the start to the stop of the audio signal with a smoothing window. For each current clip, if the confidence of the clip is lower than a threshold and the class of the clip is different from the median of the classes of the clips in the smoothing window centered at the clip, the class of the clip is updated with the median. Further, it is possible to smooth the clips with different smoothing windows. The threshold is used to determine whether a confidence can indicate a correct classification. It can be set in advance, or can be learned by testing the classifier with a sample set.

At step 505, class boundaries of the music clips are detected as candidate boundaries.

In a further implementation of step 505, it is also possible to detect positions as candidate boundaries if feature dissimilarities between two windows disposed about the position within any music segment in the audio signal is higher than the threshold $TH_D$.

Various methods of evaluating the feature dissimilarity between features of two windows can be adopted at step 505. For example, the feature dissimilarity between two windows may be calculated as Kullback-Leibler Divergence (KLD).

In an example, the feature dissimilarity $D_{sKLD}$ may be calculated as a symmetric KLD by Eq. (1). Various features extracted from frames may be used for calculating the feature dissimilarity.

In a further implementation of step 505, for each boundary t of the candidate boundaries, it is possible to calculate at least one content coherence distance between two windows (e.g., one minute long) surrounding the boundary t. If more than one content coherence distances are calculated for one boundary, features for calculating the content coherence distances are at least partly different from each other.

For each boundary t of the candidate boundaries, a possibility (e.g., confidence) that boundary t is the true boundary of a song is calculated based on the at least one corresponding content coherence distance. Various methods may be adopted to calculate the possibility. For example, a sigmoid function may be adopted to calculate the possibility. For another example, the possibility conf may be calculated based on the content coherence distance $D_{coh}$ by Eq. (3).

If multiple content coherence distances are computed based on different features, they can be combined in various ways. For example, it is possible to set the possibility to VH if all the content coherence distances are larger than the corresponding upper-bound thresholds, or more loosely, if any one of the content coherence distances is larger than the corresponding upper-bound threshold. Another probabilistic way is to build a model to represent the joint distribution model of these distances based on a training set.

If the possibility indicates that boundary t is a false boundary, it is possible to perform the following processing.

If boundary t is within a music segment, boundary t may be removed if the music segment including only boundary t and bounded by two candidate boundaries has a length smaller than the predetermined maximum song duration.

If a speech segment bounded by boundary t and another candidate boundary has a length smaller than a threshold, the two candidate boundaries may be identified as to-be-removed. The threshold may be obtained based on statistics on speech segments between two songs.

All the to-be-removed candidate boundaries may be removed, or one or more pairs of two to-be-removed candidate boundaries bounding a music segment may be changed as the second type and the remaining to-be-removed candidate boundaries may be removed.

In a further implementation of step 505, in case that the possibility neither indicates that boundary t is a true boundary nor indicates that boundary t is a false boundary, if boundary t is of the second type (that is, within a music segment), a probability $P(H_0)$ that two music segments of durations $l_1$ and $l_2$ adjoining with each other at boundary t are two true songs may be calculated with a pre-trained song duration model, and a probability $P(H_1)$ that a music segment obtained by merging the two music segments is a true song may be calculated with the pre-trained song duration model. If the condition defined by Eq. (4) is not met, it is possible to remove boundary t.

In a further implementation of step 505, it is possible to search for one or more pairs of two repetitive sections $[t_1, t_2]$ and $[t_1+l, t_2+l]$ in the audio signal, where the lag l is shorter than the predetermined maximum song duration.

If one candidate boundary in the section $[t_1, t_2+l]$ is within a music segment, it is possible to remove the candidate boundary. If a speech segment in the section $[t_1, t_2+l]$ bounded by two candidate boundaries has a length smaller than a threshold, it is possible to identify the two candidate boundaries as to-be-removed. All the to-be-removed candidate boundaries may be removed, or one or more pairs of two to-be-removed candidate boundaries bounding a music segment may be changed as the second type and the remaining to-be-removed candidate boundaries may be removed. The threshold may be obtained based on statistics on the length of music segments misclassified as speech in sample songs.

Various methods of detecting repetitive sections in audio signals may be adopted to search for repetitive sections in the segments. For example, methods based on similarity matrix or time-lag similarity matrix may be adopted.

In a further implementation of step 505, it is possible to calculate an adaptive threshold for binarizing the similarity matrix based on a percentile. In case of sorting similarity values in the similarity matrix in descending order, only the first small percentage of the similarity values depending on the percentile are binarized to repetition. The percentile is a product of the proportion of the music clips in the corresponding segment and a pre-defined base percentile.

In a further implementation of step 505, it is possible to only search for the repetitive sections longer than a threshold. The threshold may be obtained based on statistics on the length of repetitive sections in sample songs.

In a further implementation of step 505, it is possible to search for sections $[t_1, t_2]$ and $[t_1+l, t_2+l]$ such that the music clips are in the majority of section $[t_1, t_2+l]$. For example, the proportion of the clips classified as music in section $[t_1, t_2+l]$ is greater than 50%. For another example, the proportion m1 of the clips classified as music in the section $[t_1, t_2]$, the proportion m2 of the clips classified as music in the section $[t_1+l, t_2+l]$, the proportion mc of the clips classified as music in the section $[t_2, t_1+l]$ and the sum ms of m1, m2 and mc may meet some conditions, such as one of the following conditions:

$$m1>0.5 \text{ and } m2>0.5 \text{ and } mc>0.5 \qquad \text{condition1:}$$

$$m1>0.1 \text{ and } m2>0.1 \text{ and } mc>0.1 \text{ and } ms>1.8. \qquad \text{condition 2:}$$

It should be noted that, in case of verifying the candidate boundaries based on both content coherence and repetitive sections, they can be performed in either order.

In a further implementation of step 505, it is possible to merge two of the candidate boundaries spaced with a distance smaller than a threshold as one candidate boundary. The threshold may be a value smaller than or equal to the minimum song duration. The merged candidate boundary may be any one position between the two candidate boundaries.

At step 507, at least one combination including non-overlapped sections bounded by the candidate boundaries is derived. The sections meet the above conditions 1) to 4).

The predetermined minimum song duration and the predetermined maximum song duration may be determined from statistics on length of various songs, or may be specified by a user who desires songs of a length within a specific range.

Any portion bounded between two candidate boundaries in the audio signal meeting conditions 1) to 4) may be regarded as a possible section. Therefore, there may be multiple possible sections in the audio signal. The possible sections not overlapped with each other may be selected to for a combination. Alternatively, depending on specific application requirements, the number of sections in combinations may be set to a specific number, e.g., 2, 3 and so on.

In a further implementation of step 507, it is possible to detect each music segment bounded by two subsequent candidate boundaries $t_1$ and $t_2$ and longer than the predetermined minimum song duration as a candidate song, and form the combination by including the candidate song $[t_1, t_2]$ or their extensions as a section. The sections in the formed combination are not overlapped with each other, and also meet the above-mentioned conditions 1) to 4). Each extension may be obtained by at least one of the followings:

extending the boundary $t_1$ of the candidate song $[t_1, t_2]$ to the candidate boundary $t_1-l_1$ of a music segment $[t_1-l_1, t_1-l_2]$ in the left direction; and extending the boundary $t_2$ of the candidate song $[t_1, t_2]$ to the candidate boundary $t_2+l_4$ of a music segment $[t_2+l_3, t_2+l_4]$ in the right direction.

In case of verifying the candidate boundaries based on content coherence as described in the above, in a further implementation of step 507, it is possible to obtain the extensions in a way such that:

the extending in the left direction is stopped if the possibility based on the content coherence distance of the candidate boundary $t_1-l_1$ of the music segment $[t_1-l_1, t_1-l_2]$ being extended to indicates that the candidate boundary $t_1-l_1$ is a true son boundary, and the extending in the right direction is stopped if the possibility based on the content coherence distance of the candidate boundary $t_2+l_4$ of the music segment $[t_2+l_3, t_2+l_4]$ being extended to indicates that the candidate boundary $t_2+l_4$ is a true song boundary.

Further, it is possible to incorporate a requirement that if a non-music (e.g., speech) segment is to be included in performing the extending and the non-music segment is longer than a pre-defined threshold, the extending may be stopped.

Method 500 ends at step 509.

In a further implementation of step 507, more than one combination may be derived. In this case, step 507 may further comprise separating the combinations into different groups. Every combination in each group includes the same candidate song(s) and each section in the combination includes the same candidate song(s) with one section in another combination of the same group. For every two combinations of different groups, at least one section in one of the two combinations does not include the same candidate song(s) with each section in another of the two combinations.

Refining Song Detection Result

Figure 6:
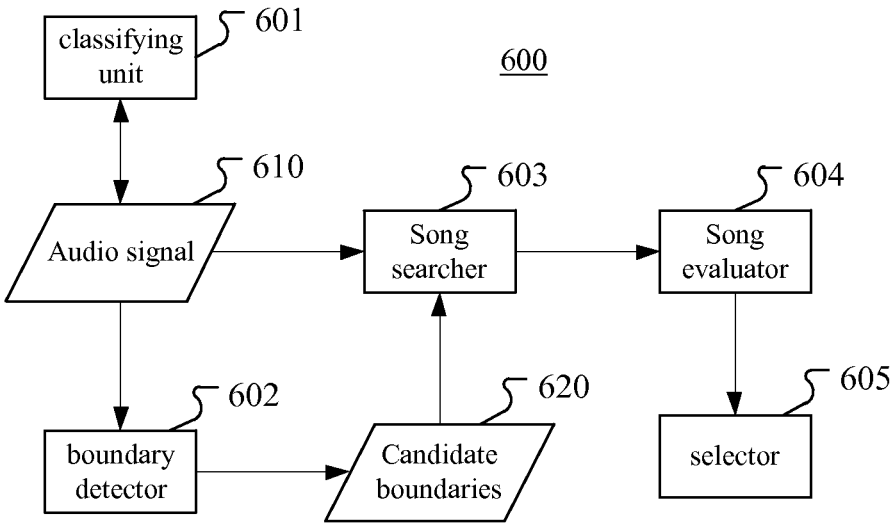
FIG. 6 is a block diagram illustrating an example apparatus for performing song detection on an audio signal according to an embodiment of the present invention.

FIG. 6 is a block diagram illustrating an example apparatus 600 for performing song detection on an audio signal according to an embodiment of the present invention.

As illustrated in FIG. 6, apparatus 600 includes a classifying unit 601, a boundary detector 602, a song searcher 603, a song evaluator 604 and a selector 605. Classifying unit 601, boundary detector 602 and song searcher 603 have the same functions as that of classifying unit 101, boundary detector 102 and song searcher 103 respectively, and will not be described in detail herein.

For each combination, song evaluator 604 evaluates a possibility that all the intervals for separating the sections represent true song partitions with an evaluation model trained based on at least one of song duration, interval between songs, and song probability.

Some characteristics are observed that, for two subsequent songs, duration of the songs complies with a song duration distribution, and non-song duration (interval) between the songs complies with a song interval distribution. Further, features extracted from the songs exhibit some characteristics different from that of non-songs.

For each combination, every section in the combination is assumed as a true song, and the combination represents a possible song partition in the audio signal. One or more of the above characteristics may be adopted to determine whether the combination can represent a true song partition. For example, it is possible to train a song duration model for evaluating whether a section is a true song based on statistics on durations of a set of sample songs, and estimate the possibility that a section is a true song with the trained model based on the length of the section. For another example, it is possible to train a non-song model for evaluating whether the portion between two adjacent sections is a non-song based on statistics on intervals between subsequent sample songs, and estimate the possibility that the portion between two subsequent sections is non-song with the trained model based on the interval between the sections. For another example, it is possible to train a song probability model for evaluating whether a section is a true song based on the features extracted from a set of sample songs, and estimate the possibility that a section is a true song with the trained model based on the features extracted from the section. Other criteria may also be adopted to determine whether the combination can represent a true song partition. If more than one possibility is obtained, it is possible to combine them in a joint model to obtain a final possibility. For example, it is possible to calculate mean or a joint probability function of respective possibilities.

In an example of the joint probability function, the final possibility may be calculated in form of average or product of confidence P([e, s]) for all the intervals [e, s] for separating the one or more sections in the corresponding combination, where if one intervals [e, s] separates two adjacent sections $[s_1,e]$ and $[s,e_2]$, the confidence P([e, s]) is calculated as $$P([e,s])=P_{dur}([s_1,e])P_{dur}([s,e_2])^{\alpha}P_{ns}^{\beta}([e,s])P_{song}([s_1,e])P_{song}([s,e_2]) \quad (5\text{-}1)$$

and if there is only one section [x,y] in the corresponding combination, the confidence P([e, s]) is calculated as $$P([e,s])=P_{dur}([x,y])\,P_{song}([x,y]) \quad (5\text{-}2)$$

where $P_{dur}(\,)$ (is a pre-trained song duration model, $P_{ns}(\,)$is a pre-trained non-song duration model which is estimated as a Gamma distribution, $P_{song}(\,)$ is a song probability model indicating the probability that a section is a true song, and $\alpha$ and $\beta$ are flatting coefficients to deal with the different scales of different probabilistic distributions.

Selector 605 selects one combination with the highest possibility. Sections in the combination are regarded as true songs.

In a further embodiment of selector 605, for each boundary b of every section in the selected combination, selector 605 may calculate a log likelihood difference ΔBIC(t) based on a Bayesian Information Criteria (BIC) based method for each frame position t in a BIC window centered at boundary b, and adjust boundary b to the frame position t corresponding to a peak ΔBIC(t).

Figure 7:
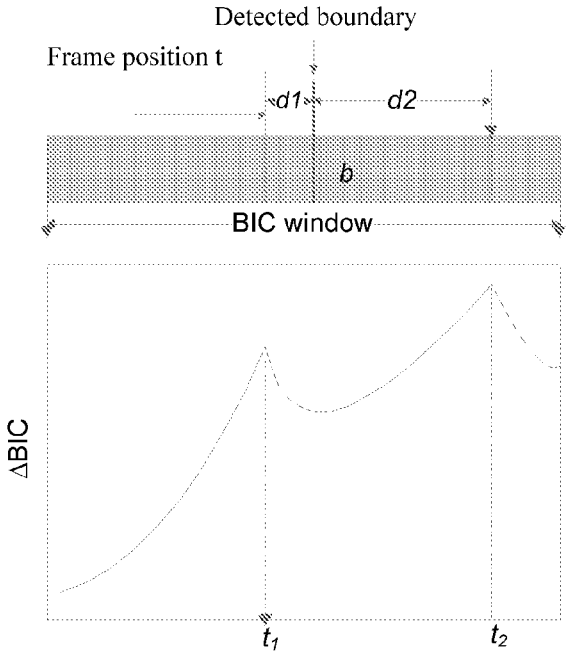
FIG. 7 is a schematic view for illustrating the relation between a log likelihood difference $\Delta BIC(t)$ and a Bayesian Information Criteria (BIC) window.

FIG. 7 is a schematic view for illustrating the relation between ΔBIC(t) and the BIC window. As illustrated in FIG. 7, ΔBIC(t) may be calculated as $\Delta BIC(t)=BIC(H_0)-BIC(H_1)$, which is a difference between two hypothesis $H_0$ and $H_1$, where BIC(H) represents the log likelihood under a hypothesis H, $H_0$ represents a hypothesis that frame boundary t is a true boundary and it is better to represent the window by two separated models that are split at time t, and $H_1$ represents a hypothesis that frame boundary t is not a true boundary and it is better to represent the window by only one model. In FIG. 7, there are a peak $\Delta BIC(t_1)$ and a peak $\Delta BIC(t_2)$ at frame boundaries $t_1$ and $t_2$, and $d_1$ and $d_2$ respectively represent the distance between frame boundary $t_1$ and boundary b to be refined, and the distance between frame boundary $t_2$ and boundary b.

In a further embodiment of selector 605, selector 605 may adjust boundary b to be refined to frame position t corresponding to the peak ΔBIC(t) closer to boundary b than frame position t' corresponding to another peak ΔBIC(t').

In an alternative embodiment of selector 605, for each boundary b of every section in the selected combination, selector 605 may calculate a value $R_{\Delta BIC}(t|b)=\Delta BIC(t)\cdot P_{st}(|t-b|)$ for each frame position t in a BIC window centered at boundary b, where ΔBIC(t) is a log likelihood difference calculated based on a Bayesian Information Criteria (BIC) based method, and $P_{st}(\,)$is a shift time duration model based on a Gaussian distribution with zero mean. Further, selector 605 may adjust boundary b to frame position t corresponding to the highest peak $R_{\Delta BIC}(t)$.

In an example, the frame-level features may comprise chroma feature.

Figure 8:
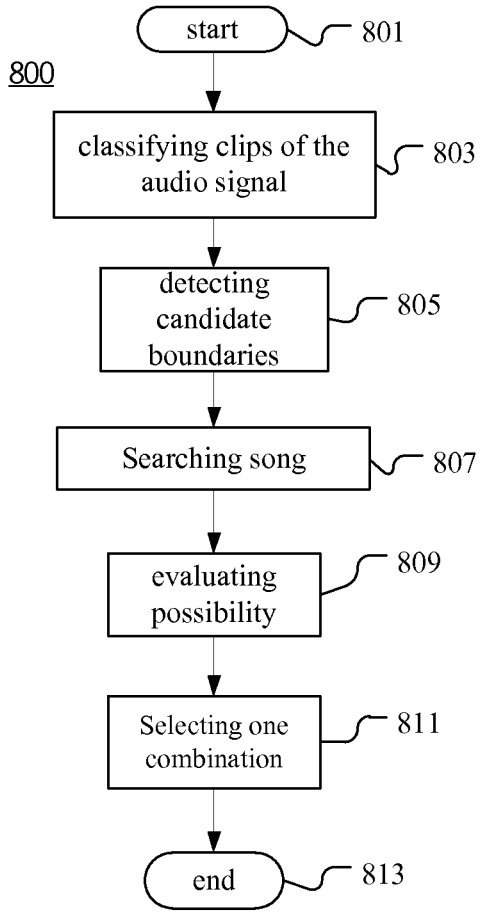
FIG. 8 is a flow chart illustrating an example method of performing song detection on an audio signal according to an embodiment of the present invention.

FIG. 8 is a flow chart illustrating an example method 800 of performing song detection on an audio signal according to an embodiment of the present invention.

As illustrated in FIG. 8, method 800 starts from step 801. Steps 801, 803, 805 and 807 have the same functions with that of steps 501, 503, 505 and 507 respectively, and will not be described in detail herein. After one or more combinations are derived at step 807, method 800 proceeds to step 809.

At step 809, for each derived combination, a possibility that all the intervals for separating the sections represent true song partitions is calculated with an evaluation model trained based on at least one of song duration, interval between songs, and song probability.

For each derived combination, every section in the combination is assumed as a true song, and the combination represents a possible song partition in the audio signal. One or more of the above characteristics may be adopted to determine whether the combination can represent a true song partition. Other criteria may also be adopted to determine whether the combination can represent a true song partition. If more than one possibility is obtained, it is possible to combine them in a joint model to obtain a final possibility. For example, it is possible to calculate mean or a joint probability function of respective possibilities.

In an example of the joint probability function, the final possibility may be calculated in form of average or product of confidence P([e, s]) for all the intervals [e, s] for separating the one or more sections in the corresponding combination based on Eqs. (5-1) and (5-2).

At step 811, one combination with the highest possibility is selected. Sections in the combination are regarded as true songs.

In a further implementation of step 811, for each boundary b of every section in the selected combination, it is possible to calculate a log likelihood difference ΔBIC(t) based on a Bayesian Information Criteria (BIC) based method for each frame position t in a BIC window centered at boundary b, and adjust boundary b to the frame position t corresponding to a peak ΔBIC(t).

In a further implementation of step 811, it is possible to adjust boundary b to be refined to frame position t corresponding to the peak ΔBIC(t) closer to boundary b than frame position t' corresponding to another peak ΔBIC(t').

In an alternative implementation of step 811, for each boundary b of every section in the selected combination, it is possible to calculate a value $R_{\Delta BIC}(t|b)=\Delta BIC(t)\cdot P_{st}(|t-b|)$ for each frame position t in a BIC window centered at boundary b, where ΔBIC(t) is a log likelihood difference calculated based on a Bayesian Information Criteria (BIC) based method, and $P_{st}(\ )$is a shift time duration model based on a Gaussian distribution with zero mean. Further, it is possible to adjust boundary b to frame position t corresponding to the highest peak $R_{\Delta BIC}(t)$.

In an example, the frame-level features may comprise chroma feature.

Figure 9:
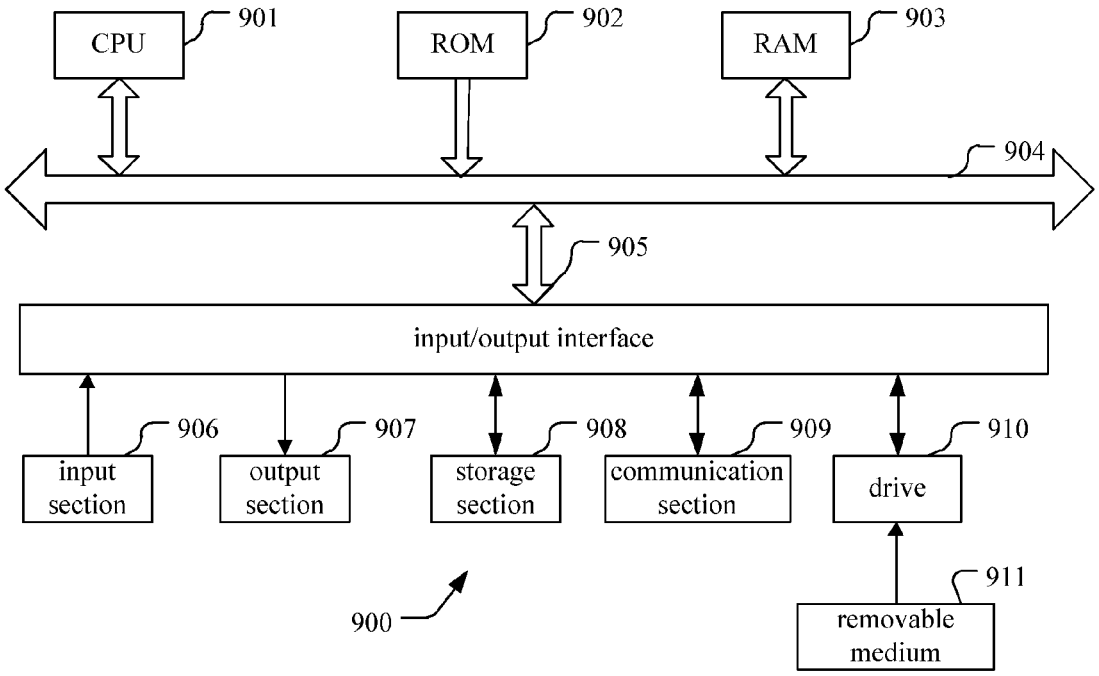
FIG. 9 is a block diagram illustrating an exemplary system for implementing aspects of the present invention.

FIG. 9 is a block diagram illustrating an exemplary system for implementing the aspects of the present invention.

In FIG. 9, a central processing unit (CPU) 901 performs various processes in accordance with a program stored in a read only memory (ROM) 902 or a program loaded from a storage section 908 to a random access memory (RAM) 903. In the RAM 903, data required when the CPU 901 performs the various processes or the like is also stored as required.

The CPU 901, the ROM 902 and the RAM 903 are connected to one another via a bus 904. An input/output interface 905 is also connected to the bus 904.

The following components are connected to the input/output interface 905: an input section 906 including a keyboard, a mouse, or the like ; an output section 907 including a display such as a cathode ray tube (CRT), a liquid crystal display (LCD), or the like, and a loudspeaker or the like; the storage section 908 including a hard disk or the like ; and a communication section 909 including a network interface card such as a LAN card, a modem, or the like. The communication section 909 performs a communication process via the network such as the internet.

A drive 910 is also connected to the input/output interface 905 as required. A removable medium 911, such as a magnetic disk, an optical disk, a magneto-optical disk, a semiconductor memory, or the like, is mounted on the drive 910 as required, so that a computer program read therefrom is installed into the storage section 908 as required.

In the case where the above-described steps and processes are implemented by the software, the program that constitutes the software is installed from the network such as the internet or the storage medium such as the removable medium 911.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The following exemplary embodiments (each an "EE") are described.

EE 1. A method of performing song detection on an audio signal, comprising:

classifying clips of the audio signal into classes comprising music;

detecting class boundaries of the music clips as candidate boundaries; and deriving at least one combination including one or more non-overlapped sections bounded by the candidate boundaries, wherein each of the sections meets the following conditions:

1) including at least one music segment longer than a predetermined minimum song duration as a candidate song, 2) shorter than a predetermined maximum song duration, 3) both starting and ending with a music clip, and 4) a proportion of the music clips in each of the sections is greater than a predetermined minimum proportion.

EE 2. The method according to EE 1, wherein the classes further comprises noise, and wherein the classifying further comprises re-classifying a noise segment adjoining with two music clips and having a length smaller than a first threshold as music.

EE 3. The method according to EE 1, wherein the classifying further comprises:

calculating confidence for the class of each of the clips;

smoothing the clips from the start to the stop of the audio signal with a smoothing window, wherein for each current clip, if the confidence of the current clip is lower than a second threshold and the class of the current clip is different from the median of classes of the clips in the smoothing window centered at the current clip, the class of the current clip is updated with the median; and smoothing the clips from the start to the stop of the audio signal with different smoothing windows, where for each current clip, if the confidence of the current clip is lower than a third threshold and the class of the current clip is different from the median of classes of the clips in smoothing windows centered at the current clip, the class of the current clip is updated with the median.

EE 4. The method according to EE 1, wherein the class boundaries are detected as a first type, and the detecting further comprises:

detecting every position within every music segment as candidate boundaries of a second type, wherein the position is detected if a content dissimilarity between two first windows disposed about the position is higher than a fourth threshold.

EE 5. The method according to EE 4, wherein the classes further comprise speech, and the detecting further comprises:

searching for two repetitive sections $[t_1, t_2]$ and $[t_1+l, t_2+l]$ in the audio signal, with l is shorter than the predetermined maximum song duration;

if one of the candidate boundaries in the section $[t_1, t_2+l]$ is within a music segment, removing the candidate boundary;

if a speech segment in the section $[t_1, t_2+l]$ bounded by two of the candidate boundaries has a length smaller than a fifth threshold, identifying the two candidate boundaries as to-be-removed; and removing all the to-be-removed candidate boundaries, or changing one or more pairs of two to-be-removed candidate boundaries bounding a music segment as the second type and removing the remaining to-be-removed candidate boundaries.

EE 6. The method according to EE 5, wherein the music clips are in the majority of section $[t_1, t_2+l]$.

EE 7. The method according to EE 5, wherein the length of the repetitive sections is greater than a sixth threshold.

EE 8. The method according to EE 5, wherein the repetitive sections are searched for through the method of similarity matrix, where the adaptive threshold for binarizing the similarity matrix is obtained based on a percentile such that in case of sorting similarity values in the similarity matrix in descending order, only the first small percentage of the similarity values depending on the percentile is binarized to a value representing repetition, and wherein the percentile is a product of the proportion of the music clips in the corresponding segment and a predefined base percentile.

EE 9. The method according to EE 4, wherein the detecting comprises merging two of the candidate boundaries spaced with a distance smaller than a seventh threshold as one candidate boundary.

EE 10. The method according to EE 4, wherein the detecting further comprises:

calculating at least one content coherence distance between two second windows longer than the first windows surrounding each of the candidate boundaries, where features for calculating the at least one content coherence distance are at least partly different from each other;

for each of the candidate boundaries, calculating a first possibility that the candidate boundary is the true boundary of a song based on the at least one corresponding content coherence distance; and if the first possibility indicates that the candidate boundary is a false boundary, if the candidate boundary is within a music segment, removing the candidate boundary if the music segment including only the candidate boundary and bounded by two of the candidate boundaries has a length smaller than the predetermined maximum song duration;

if a speech segment bounded by the candidate boundary and another candidate boundary has a length smaller than an eighth threshold, identifying the two candidate boundaries as to-be-removed; and removing all the to-be-removed candidate boundaries, or changing one or more pairs of two to-be-removed candidate boundaries bounding a music segment as the second type and removing the remaining to-be-removed candidate boundaries.

EE 11. The method according to EE 10, wherein if all or one of the at least one corresponding content coherence distance is greater than a ninth threshold, the corresponding first possibility is calculated as a value indicates that the corresponding boundary is the true boundary of a song.

EE 12. The method according to EE 10, wherein in case that the first possibility neither indicates that the candidate boundary is a true boundary nor indicates that the candidate boundary is a false boundary, if the candidate boundary is of the second type, the detecting further comprises:

calculating a probability $P(H_0)$ that two music segments of durations $l_1$ and $l_2$ adjoining with each other at the candidate boundary are two true songs with a pre-trained song duration model;

calculating a probability $P(H_1)$ that a music segment obtained by merging the two music segments is a true song with the pre-trained song duration model; and if the following condition is not met, removing the candidate boundary $$\frac{P(H_0)}{P(H_1)} = \frac{G(l_1)G(l_2)}{G^2(l_1+l_2)} \geq 1,$$

wherein the pre-trained song duration model is a Gaussian model $G(l;\mu,\sigma)$.

EE 13. The method according to EE 1 or 4, wherein each of the at least one combination is derived by:

detecting each music segment bounded by two subsequent candidate boundaries $t_1$ and $t_2$ and longer than the predetermined minimum song duration as the candidate song; and forming the combination by including the candidate song $[t_1, t_2]$ or their extensions as a section, wherein each extension is obtained by at least one of the followings:

extending the boundary $t_1$ of the candidate song $[t_1, t_2]$ to the candidate boundary $t_1-l_1$ of a music segment $[t_1-l_1, t_1-l_2]$ in the left direction; and extending the boundary $t_2$ of the candidate song $[t_1, t_2]$ to the candidate boundary $t_2+l_4$ of a music segment $[t_2+l_3, t_2+l_4]$ in the right direction.

EE 14. The method according to EE 1 or 4 or 13, further comprising:

evaluating a second possibility for the at least one combination that all the intervals for separating the sections represent true song partitions with an evaluation model trained based on at least one of song duration, interval between songs, and song probability; and selecting one of the at least one combination with the highest second possibility.

EE 15. The method according to EE 14, wherein the second possibility is calculated in a form of average or product of confidence P([e, s]) for all the intervals [e, ,s] for separating the one or more sections in the corresponding combination, where if one intervals [e, ,s] separates two adjacent sections $[s_1,e]$ and $[s,e_2]$, the confidence P([e, s]) is calculated as $$P([e,s])=P_{dur}([s_1,e])P_{dur}([s,e_2])^{\alpha}P_{ns}^{\beta}([e,s])P_{song}([s_1,e])P_{song}([s,e_2]),\text{ and}$$

if there is only one section [x,y] in the corresponding combination, the confidence P([e, s]) is calculated as $$P([e,s])=P_{dur}([x,y])P_{song}([x,y])$$

where $P_{dur}(\ )$is a pre-trained song duration model, $P_{ns}(\ )$is a pre-trained non-song duration model which is estimated as a Gamma distribution, $P_{song}(\ )$is a song probability model indicating the probability that a section is a true song, and $\alpha$ and $\beta$ are flatting coefficients to deal with the different scales of different probabilistic distributions.

EE 16. The method according to EE 14, wherein the classifying further comprises calculating frame-level features of frames in each of the clips, and wherein the selecting further comprises:

for each of boundaries of the at least one section of the selected combination, calculating a log likelihood difference $\Delta BIC(t)$ based on a Bayesian Information Criteria (BIC) based method for each frame position t in a BIC window centered at the boundary; and adjusting the boundary to the frame position t corresponding to a peak $\Delta BIC(t)$.

EE 17. The method according to EE 16, wherein the frame position t corresponding to the peak $\Delta BIC(t)$ is closer to the boundary than the frame position t' corresponding to another peak $\Delta BIC(t')$.

EE 18. The method according to EE 14, wherein the classifying further comprises calculating frame-level features of frames in each of the clips, and wherein the selecting further comprises:

for each of boundaries of the at least one section of the selected combination, calculating a value $R_{\Delta BIC}(t|b)=\Delta BIC(t)\cdot P_{st}(|t-b|)$ for each frame position t in a BIC window centered at the boundary, where $\Delta BIC(t)$ is a log likelihood difference calculated based on a Bayesian Information Criteria (BIC) based method, and $P_{st}(\ )$ is a shift time duration model based on a Gaussian distribution with zero mean; and adjusting the boundary to the frame position t corresponding to the highest peak $R_{\Delta BIC}(t)$.

EE 19. The method according to EE 13, wherein the detecting further comprises:

calculating at least one content coherence distance between two second windows longer than the first windows surrounding each of the candidate boundaries, where features for calculating the at least one content coherence distance are at least partly different from each other;

for each of the candidate boundaries, calculating a first possibility that the candidate boundary is the true boundary of a song based on the at least one corresponding content coherence distance; and if the first possibility indicates that the candidate boundary is a false boundary, if the candidate boundary is within a music segment, removing the candidate boundary if the music segment including only the candidate boundary and bounded by two of the candidate boundaries has a length smaller than the predetermined maximum song duration;

if a speech segment bounded by the candidate boundary and another candidate boundary has a length smaller than an eighth threshold, identifying the two candidate boundaries as to-be-removed; and removing all the to-be-removed candidate boundaries, or changing one or more pairs of two to-be-removed candidate boundaries bounding a music segment as the second type and removing the remaining to-be-removed candidate boundaries, wherein the extending in the left direction is stopped if the first possibility of the candidate boundary $t_1-l_1$ of the music segment $[t_1-l_1, t_1-l_2]$ being extended to indicates that the candidate boundary $t_1-l_1$ is a true song boundary, and the extending in the right direction is stopped if the first possibility of the candidate boundary $t_2+l_4$ of the music segment $[t_2+l_3, t_2+l_4]$ being extended to indicates that the candidate boundary $t_2+l_4$ is a true song boundary.

EE 20. The method according to EE 1, wherein the at least one combination includes more than one combinations, and wherein the deriving further comprises separating the combinations into different groups, where every combination in each group includes the same candidate song(s) and each section in the combination includes the same candidate song(s) with one section in another combination of the same group, and where for every two combinations of different groups, at least one section in one of the two combinations does not include the same candidate song(s) with each section in another of the two combinations.

EE 21. An apparatus for performing song detection on an audio signal, comprising:

a classifying unit which classifies clips of the audio signal into classes comprising music;

a boundary detector which detects class boundaries of the music clips as candidate boundaries; and a song searcher which derives at least one combination including one or more non-overlapped sections bounded by the candidate boundaries, wherein each of the sections meets the following conditions:

1) including at least one music segment longer than a predetermined minimum song duration as a candidate song, 2) shorter than a predetermined maximum song duration, 3) both starting and ending with a music clip, and 4) a proportion of the music clips in each of the sections is greater than a predetermined minimum proportion.

EE 22. The apparatus according to EE 21, wherein the classes further comprises noise, and wherein the classifying unit is further configured to reclassify a noise segment adjoining with two music clips and having a length smaller than a first threshold as music.

EE 23. The apparatus according to EE 21, wherein the classifying unit is further configured to calculate confidence for the class of each of the clips, and wherein the classifying unit further comprises:

a first median filter which smoothes the clips from the start to the stop of the audio signal, where for each current clip, if the confidence of the current clip is lower than a second threshold and the class of the current clip is different from the median of classes of the clips in the smoothing window centered at the current clip, the class of the current clip is updated with the median; and one or more second median filters with different smoothing windows, which smooth the clips from the start to the stop of the audio signal, where for each current clip, if the confidence of the current clip is lower than a third threshold and the class of the current clip is different from the median of classes of the clips in smoothing windows centered at the current clip, the class of the current clip is updated with the median.

EE 24. The apparatus according to EE 21, wherein the class boundaries are detected as a first type, and the boundary detector is further configured to detect every position within every music segment as candidate boundaries of a second type, wherein the position is detected if a content dissimilarity between two first windows disposed about the position is higher than a fourth threshold.

EE 25. The apparatus according to EE 24, wherein the classes further comprise speech, and the boundary detector is further configured to search for two repetitive sections $[t_1, t_2]$ and $[t_1+l, t_2+l]$ in the audio signal, with l is shorter than the predetermined maximum song duration;

if one of the candidate boundaries in the section $[t_i, t_2+l]$ is within a music segment, remove the candidate boundary;

if a speech segment in the section $[t_1, t_2+l]$ bounded by two of the candidate boundaries has a length smaller than a fifth threshold, identify the two candidate boundaries as to-be-removed; and remove all the to-be-removed candidate boundaries, or change one or more pairs of two to-be-removed candidate boundaries bounding a music segment as the second type and remove the remaining to-be-removed candidate boundaries.

EE 26. The apparatus according to EE 25, wherein the music clips are in the majority of section $[t_1, t_2+l]$.

EE 27. The apparatus according to EE 25, wherein the length of the repetitive sections is greater than a sixth threshold.

EE 28. The apparatus according to EE 25, wherein the repetitive sections are searched for through the method of similarity matrix, where the adaptive threshold for binarizing the similarity matrix is obtained based on a percentile such that in case of sorting similarity values in the similarity matrix in descending order, only the first small percentage of the similarity values depending on the percentile is binarized to a value representing repetition, and wherein the percentile is a product of the proportion of the music clips in the corresponding segment and a predefined base percentile.

EE 29. The apparatus according to EE 24, wherein the boundary detector is further configured to merge two of the candidate boundaries spaced with a distance smaller than a seventh threshold as one candidate boundary.

EE 30. The apparatus according to EE 24, wherein the boundary detector is further configures to calculate at least one content coherence distance between two second windows longer than the first windows surrounding each of the candidate boundaries, where features for calculating the at least one content coherence distance are at least partly different from each other;

for each of the candidate boundaries, calculate a first possibility that the candidate boundary is the true boundary of a song based on the at least one corresponding content coherence distance; and if the first possibility indicates that the candidate boundary is a false boundary, if the candidate boundary is within a music segment, remove the candidate boundary if the music segment including only the candidate boundary and bounded by two of the candidate boundaries has a length smaller than the predetermined maximum song duration;

if a speech segment bounded by the candidate boundary and another candidate boundary has a length smaller than an eighth threshold, identify the two candidate boundaries as to-be-removed; and remove all the to-be-removed candidate boundaries, or change one or more pairs of two to-be-removed candidate boundaries bounding a music segment as the second type and remove the remaining to-be-removed candidate boundaries.

EE 31. The apparatus according to EE 30, wherein if all or one of the at least one corresponding content coherence distance is greater than a ninth threshold, the corresponding first possibility is calculated as a value indicates that the corresponding boundary is the true boundary of a song.

EE 32. The apparatus according to EE 30, wherein in case that the first possibility neither indicates that the candidate boundary is a true boundary nor indicates that the candidate boundary is a false boundary, if the candidate boundary is of the second type, the boundary detector is further configured to calculate a probability $P(H_0)$ that two music segments of durations $l_1$ and $l_2$ adjoining with each other at the candidate boundary are two true songs with a pre-trained song duration model;

calculate a probability $P(H_1)$ that a music segment obtained by merging the two music segments is a true song with the pre-trained song duration model; and if the following condition is not met, remove the candidate boundary $$\frac{P(H_0)}{P(H_1)} = \frac{G(l_1)G(l_2)}{G^2(l_1+l_2)} \geq 1,$$

wherein the pre-trained song duration model is a Gaussian model $G(l;\mu,\sigma)$.

EE 33. The apparatus according to EE 21 or 24, wherein each of the at least one combination is derived by:

detecting each music segment bounded by two subsequent candidate boundaries $t_1$ and $t_2$ and longer than the predetermined minimum song duration as the candidate song; and forming the combination by including the candidate song $[t_1, t_2]$ or their extensions as a section, wherein each extension is obtained by at least one of the followings:

extending the boundary $t_1$ of the candidate song $[t_1, t_2]$ to the candidate boundary $t_1-l_1$ of a music segment $[t_1-l_1, t_1-l_2]$ in the left direction; and extending the boundary $t_2$ of the candidate song $[t_1, t_2]$ to the candidate boundary $t_2+l_4$ of a music segment $[t_2+l_3, t_2+l_4]$ in the right direction.

EE 34. The apparatus according to EE 21 or 24 or 33, further comprising:

a song evaluator which evaluates a second possibility for the at least one combination that all the intervals for separating the sections represent true song partitions with an evaluation model trained based on at least one of song duration, interval between songs, and song probability; and a selector which selects one of the at least one combination with the highest second possibility.

EE 35. The apparatus according to EE 34, wherein the second possibility is calculated in a form of average or product of confidence P([e, s]) for all the intervals [e, s] for separating the one or more sections in the corresponding combination, where if one intervals [e, s] separates two adjacent sections $[s_1,e]$ and $[s,e_2]$, the confidence P([e, s]) is calculated as $$P([e,s])=P_{dur}([s_1,e])P_{dur}([s,e_2])^{\alpha}P_{ns}^{\beta}([e,s])P_{song}([s_1,e])P_{song}([s,e_2]), \text{ and}$$

if there is only one section [x,y] in the corresponding combination, the confidence P([e, s]) is calculated as $$P([e,s])=P_{dur}([x,y])P_{song}([x,y])$$

where $P_{dur}(\ )$is a pre-trained song duration model, $P_{ns}(\ )$is a pre-trained non-song duration model which is estimated as a Gamma distribution, $P_{song}(\ )$ is a song probability model indicating the probability that a section is a true song, and $\alpha$ and $\beta$ are flatting coefficients to deal with the different scales of different probabilistic distributions.

EE 36. The apparatus according to EE 34, wherein the classifying unit is further configured to calculate frame-level features of frames in each of the clips, and wherein the selector is further configured to for each of boundaries of the at least one section of the selected combination, calculate a log likelihood difference ΔBIC(t) based on a Bayesian Information Criteria (BIC) based method for each frame position t in a BIC window centered at the boundary; and adjust the boundary to the frame position t corresponding to a peak ΔBIC(t).

EE 37. The apparatus according to EE 36, wherein the frame position t corresponding to the peak ΔBIC(t) is closer to the boundary than the frame position t' corresponding to another peak ΔBIC(t').

EE 38. The apparatus according to EE 34, wherein the classifying unit is further configured to calculate frame-level features of frames in each of the clips, and wherein the selector is further configured to for each of boundaries of the at least one section of the selected combination, calculate a value $R_{\Delta BIC}(t|b)=\Delta BIC(t)\cdot P_{st}(|t-b|)$ for each frame position t in a BIC window centered at the boundary, where ΔBIC(t) is a log likelihood difference calculated based on a Bayesian Information Criteria (BIC) based method, and $P_{st}(\ )$is a shift time duration model based on a Gaussian distribution with zero mean; and adjust the boundary to the frame position t corresponding to the highest peak $R_{\Delta BIC}(t)$, EE 39. The apparatus according to EE 33, wherein the boundary detector is further configured to calculate at least one content coherence distance between two second windows longer than the first windows surrounding each of the candidate boundaries, where features for calculating the at least one content coherence distance are at least partly different from each other;

for each of the candidate boundaries, calculate a first possibility that the candidate boundary is the true boundary of a song based on the at least one corresponding content coherence distance; and if the first possibility indicates that the candidate boundary is a false boundary, if the candidate boundary is within a music segment, remove the candidate boundary if the music segment including only the candidate boundary and bounded by two of the candidate boundaries has a length smaller than the predetermined maximum song duration;

if a speech segment bounded by the candidate boundary and another candidate boundary has a length smaller than an eighth threshold, identify the two candidate boundaries as to-be-removed; and remove all the to-be-removed candidate boundaries, or change one or more pairs of two to-be-removed candidate boundaries bounding a music segment as the second type and remove the remaining to-be-removed candidate boundaries, wherein the extending in the left direction is stopped if the first possibility of the candidate boundary $t_1-l_2$ of the music segment $[t_1-l_1, t_1-l_2]$ being extended to indicates that the candidate boundary $t_1-l_2$ is a true song boundary, and the extending in the right direction is stopped if the first possibility of the candidate boundary $t_2+l_4$ of the music segment $[t_2+l_3, t_2+l_4]$ being extended to indicates that the candidate boundary $t_2+l_4$ is a true song boundary.

EE 40. The apparatus according to EE 21, wherein the at least one combination includes more than one combinations, and wherein the song searcher is further configured to separate the combinations into different groups, where every combination in each group includes the same candidate song(s) and each section in the combination includes the same candidate song(s) with one section in another combination of the same group, and where for every two combinations of different groups, at least one section in one of the two combinations does not include the same candidate song(s) with each section in another of the two combinations.

EE 41. A computer-readable medium having computer program instructions recorded thereon, when being executed by a processor, the instructions enabling the processor to execute a method of performing song detection on an audio signal, comprising:

classifying clips of the audio signal into classes comprising music;

detecting class boundaries of the music clips as candidate boundaries; and deriving at least one combination including one or more non-overlapped sections bounded by the candidate boundaries, wherein each of the sections meets the following conditions:

1) including at least one music segment longer than a predetermined minimum song duration as a candidate song, 2) shorter than a predetermined maximum song duration, 3) both starting and ending with a music clip, and 4) a proportion of the music clips in each of the sections is greater than a predetermined minimum proportion.

We claim:

1. A method of performing song detection on an audio signal, comprising:

classifying clips of the audio signal into classes comprising music and non-music;

detecting class boundaries of the music clips as candidate boundaries; and deriving at least one combination including one or more non-overlapped sections bounded by the candidate boundaries, each of the at least one combination is derived by:

detecting each music segment bounded by two subsequent candidate boundaries $t_1$ and $t_2$ and longer than a predetermined minimum song duration as a candidate song; and forming the combination by including the candidate song $[t_1\ t_2]$ with their extensions as a section, wherein each extension is obtained by at least one of the following:

extending the boundary $t_1$ of the candidate song $[t_1, t_2]$ to the candidate boundary $t_1 - l_1$ of a music segment $[t_1 - l_1, t_1 - l_2]$ in the left direction; and extending the boundary $t_2$ of the candidate song $[t_1, t_2]$ to the candidate boundary $t_2 + l_4$ of a music segment $[t_2 + l_3, t_2 + l_4]$ in the right direction, 11, 12, 13, and 14 are shifting parameters;

wherein the candidate boundary is based upon a content coherence distance which indicates that a candidate boundary is true, and wherein each of the sections meets the following conditions:

1) including at least one music segment longer than a predetermined minimum song duration as a candidate song, 2) shorter than a predetermined maximum song duration, 3) both starting and ending with a music clip, and 4) a proportion of the music clips in each of the sections is greater than a predetermined minimum proportion.

2. The method according to claim 1, wherein the class boundaries are detected as a first type, and the detecting further comprises:

detecting every position within every music segment as candidate boundaries of a second type, wherein the position is detected if a content dissimilarity between two first windows disposed about the position is higher than a first threshold.

3. The method according to claim 2, wherein the classes further comprise speech, and the detecting further comprises:

searching for two repetitive sections $[t_1, t_2]$ and $[t_1 + l, t_2 + l]$ in the audio signal, with l is shorter than the predetermined maximum song duration;

if one of the candidate boundaries in the section $[t_1, t_2 + l]$ is within a music segment, removing the candidate boundary;

if a speech segment in the section $[t_1, t_2 + l]$ bounded by two of the candidate boundaries has a length smaller than a second threshold, identifying the two candidate boundaries as to-be-removed; and removing all the to-be-removed candidate boundaries, or changing one or more pairs of two to-be-removed candidate boundaries bounding a music segment as the second type and removing the remaining to-be-removed candidate boundaries.

4. The method according to claim 2, wherein the detecting further comprises:

calculating at least one content coherence distance between two second windows longer than the first windows surrounding each of the candidate boundaries, where features for calculating the at least one content coherence distance are at least partly different from each other;

for each of the candidate boundaries, calculating a first possibility that the candidate boundary is the true boundary of a song based on the at least one corresponding content coherence distance; and if the first possibility indicates that the candidate boundary is a false boundary, if the candidate boundary is within a music segment, removing the candidate boundary if the music segment including only the candidate boundary and bounded by two of the candidate boundaries has a length smaller than the predetermined maximum song duration;

if a speech segment bounded by the candidate boundary and another candidate boundary has a length smaller than a third threshold, identifying the two candidate boundaries as to-be-removed; and removing all the to-be-removed candidate boundaries, or changing one or more pairs of two to-be-removed candidate boundaries bounding a music segment as the second type and removing the remaining to-be-removed candidate boundaries.

5. The method according to claim 1, further comprising:

evaluating a second possibility for the at least one combination that all the intervals for separating the sections represent true song partitions with an evaluation model trained based on at least one of song duration, interval between songs, and song probability; and selecting one of the at least one combination with the highest second possibility.

6. The method according to claim 5, wherein the second possibility is calculated in a form of average or product of confidence P([e, s]) for all the intervals [e, s] for separating the one or more sections in the corresponding combination, where if one intervals [e, s] separates two adjacent sections $[s_1, e]$ and $[s, e_2]$, the confidence P([e, s]) is calculated as $$P([e,s]) = P_{dur}([s_1,e])P_{dur}([s,e_2])^{\alpha}P_{ns}^{\beta})[e,s])P_{song}([s_1,e])P_{song}([s,e_2]), \text{ and}$$

if there is only one section [x,y] in the corresponding combination, the confidence P([e, s]) is calculated as $$P([e,s]) = P_{dur}([x,y])P_{song}([x,y])$$

where $P_{dur}(\ )$ is a pre-trained song duration model, $P_{ns}(\ )$is a pre-trained non-song duration model which is estimated as a Gamma distribution, $P_{song}(\ )$ is a song probability model indicating the probability that a section is a true song, and $\alpha$ and $\beta$ are flatting coefficients to deal with the different scales of different probabilistic distributions.

7. The method according to claim 5, wherein the classifying further comprises calculating frame-level features of frames in each of the clips, and wherein the selecting further comprises:

for each of boundaries of the at least one section of the selected combination, calculating a log likelihood difference $\Delta BIC(t)$ based on a Bayesian Information Criteria (BIC) based method for each frame position t in a BIC window centered at the boundary; and adjusting the boundary to the frame position t corresponding to a peak $\Delta BIC(t)$.

8. The method according to claim 5, wherein the classifying further comprises calculating frame-level features of frames in each of the clips, and wherein the selecting further comprises:

for each of boundaries of the at least one section of the selected combination, calculating a value $R_{\Delta BIC}$ $(t|b)=\Delta BIC(t)\cdot P_{st}(|t-b|)$ for each frame position t in a BIC window centered at the boundary, where $\Delta BIC(t)$ is a log likelihood difference calculated based on a Bayesian Information Criteria (BIC) based method, and $P_{st}(\ )$ is a shift time duration model based on a Gaussian distribution with zero mean; and adjusting the boundary to the frame position t corresponding to the highest peak $R_{\Delta BIC}(t)$.

9. The method according to claim 1, wherein the at least one combination includes more than one combinations, and wherein the deriving further comprises separating the combinations into different groups, where every combination in each group includes the same candidate song(s) and each section in the combination includes the same candidate song(s) with one section in another combination of the same group, and where for every two combinations of different groups, at least one section in one of the two combinations does not include the same candidate song(s) with each section in another of the two combinations.

10. An apparatus for performing song detection on an audio signal, comprising:

a processor with associated memory that includes;

a classifying unit which classifies clips of the audio signal into classes comprising music and non-music;

a boundary detector which detects class boundaries of the music clips as candidate boundaries; and a song searcher which derives at least one combination including one or more non-overlapped sections bounded by the candidate boundaries, each of the at least one combination is derived by:

detecting each music segment bounded by two subsequent candidate boundaries $t_1$ and $t_2$ and longer than a predetermined minimum song duration as a candidate song; and forming the combination by including the candidate song $[t_1, t_2]$ with their extensions as a section, wherein each extention is obtained by at least one of the following:

extending the boundary $t_1$ of the candidate song $[t_1, t_2]$ to the candidate boundary $t_1-l_1$ of a music segment $[t_1-l_1, t_1-l_2]$ in the left direction; and extending the boundary $t_2$ of the candidate song $[t_1, t_2]$ to the candidate boundary $t_2+l_4$ of a music segment $[t_2+l_3, t_2+l_4]$ in the right direction, 11, 12, 13, and 14 are shifting parameters;

wherein the candidate boundary is based upon a contact coherence distance which indicate that a candidate boundary is true, and wherein each of the sections meets the following conditions:

1) including at least one music segment longer than a predetermined minimum song duration as a candidate song, 2) shorter than a predetermined maximum song duration, 3) both starting and ending with a music clip, and 4) a proportion of the music clips in each of the sections is greater than a predetermined minimum proportion.

11. The apparatus according to claim 10, wherein the class boundaries are detected as a first type, and the boundary detector is further configured to detect every position within every music segment as candidate boundaries of a second type, wherein the position is detected if a content dissimilarity between two first windows disposed about the position is higher than a first threshold.

12. The apparatus according to claim 11, wherein the classes further comprise speech, and the boundary detector is further configured to search for two repetitive sections $[t_1, t_2]$ and $[t_1+l, t_2+l]$ in the audio signal, with l is shorter than the predetermined maximum song duration;

if one of the candidate boundaries in the section $[t_1, t_2+l]$ is within a music segment, remove the candidate boundary;

if a speech segment in the section $[t_1, t_2+l]$ bounded by two of the candidate boundaries has a length smaller than a second threshold, identify the two candidate boundaries as to-be-removed; and remove all the to-be-removed candidate boundaries, or change one or more pairs of two to-be-removed candidate boundaries bounding a music segment as the second type and remove the remaining to-be-removed candidate boundaries.

13. The apparatus according to claim 12, wherein the boundary detector is further configures to calculate at least one content coherence distance between two second windows longer than the first windows surrounding each of the candidate boundaries, where features for calculating the at least one content coherence distance are at least partly different from each other;

for each of the candidate boundaries, calculate a first possibility that the candidate boundary is the true boundary of a song based on the at least one corresponding content coherence distance; and if the first possibility indicates that the candidate boundary is a false boundary, if the candidate boundary is within a music segment, remove the candidate boundary if the music segment including only the candidate boundary and bounded by two of the candidate boundaries has a length smaller than the predetermined maximum song duration;

if a speech segment bounded by the candidate boundary and another candidate boundary has a length smaller than a third threshold, identify the two candidate boundaries as to-be-removed; and remove all the to-be-removed candidate boundaries, or change one or more pairs of two to-be-removed candidate boundaries bounding a music segment as the second type and remove the remaining to-be-removed candidate boundaries.

14. The apparatus according to claim 10, further comprising:

a song evaluator which evaluates a second possibility for the at least one combination that all the intervals for separating the sections represent true song partitions with an evaluation model trained based on at least one of song duration, interval between songs, and song probability; and a selector which selects one of the at least one combination with the highest second possibility.

15. The apparatus according to claim 14, wherein the second possibility is calculated in a form of average or product of confidence P([e, s]) for all the intervals [e, s] for separating the one or more sections in the corresponding combination, where if one intervals [e, s] separates two adjacent sections $[s_1,e]$ and $[s,e_2]$, the confidence P([e, s]) is calculated as $$P([e,s])=P_{dur}([s_1,e])P_{dur}([s,e_2])^{\alpha}P_{ns}^{\beta}([e,s])P_{song}([s_1,e])P_{song}([s,e_2]),\text{ and}$$

if there is only one section [x,y] in the corresponding combination, the confidence P([e, s]) is calculated as $$P([e,s])=P_{dur}([x,y])P_{song}([x,y])$$

where $P_{dur}(\ )$ is a pre-trained song duration model, $P_{ns}(\ )$is a pre-trained non-song duration model which is estimated as a Gamma distribution, $P_{song}(\ )$ is a song probability model indicating the probability that a section is a true song, and $\alpha$ and $\beta$ are flatting coefficients to deal with the different scales of different probabilistic distributions.

16. The apparatus according to claim 14, wherein the classifying unit is further configured to calculate frame-level features of frames in each of the clips, and wherein the selector is further configured to for each of boundaries of the at least one section of the selected combination, calculate a log likelihood difference ΔBIC(t) based on a Bayesian Information Criteria (BIC) based method for each frame position t in a BIC window centered at the boundary; and adjust the boundary to the frame position t corresponding to a peak ΔBIC(t).

17. The apparatus according to claim 14, wherein the classifying unit is further configured to calculate frame-level features of frames in each of the clips, and wherein the selector is further configured to for each of boundaries of the at least one section of the selected combination, calculate a value $R_{\Delta BIC}(t|b)=\Delta BIC(t)\cdot P_{st}(|t-b|)$ for each frame position t in a BIC window centered at the boundary, where ΔBIC(t) is a log likelihood difference calculated based on a Bayesian Information Criteria (BIC) based method, and $P_{st}(\ )$is a shift time duration model based on a Gaussian distribution with zero mean; and adjust the boundary to the frame position t corresponding to the highest peak $R_{\Delta BIC}(t)$.

18. The apparatus according to claim 10, wherein the at least one combination includes more than one combinations, and wherein the song searcher is further configured to separate the combinations into different groups, where every combination in each group includes the same candidate song(s) and each section in the combination includes the same candidate song(s) with one section in another combination of the same group, and where for every two combinations of different groups, at least one section in one of the two combinations does not include the same candidate song(s) with each section in another of the two combinations.

* * * * *

UNITED STATES PATENT AND TRADEMARK OFFICE

CERTIFICATE OF CORRECTION

PATENT NO. : 8,595,009 B2
APPLICATION NO. : 13/559265
DATED : November 26, 2013
INVENTOR(S) : Lie Lu and Claus Bauer It is certified that error appears in the above-identified patent and that said Letters Patent is hereby corrected as shown below:

In the Claims

Column 27, claim 1, line 24, in the right direction "11, 12, 13 and 14" should be change to -- $I_1$, $I_2$, $I_3$, and $I_4$ --

Column 27, claim 10, line 46, in the right direction, "11, 12, 13 and 14" should be change to -- $I_1$, $I_2$, $I_3$, and $I_4$ --

Signed and Sealed this
Twelfth Day of August, 2014

Michelle K. Lee

Michelle K. Lee
*Deputy Director of the United States Patent and Trademark Office*